US007975600B2

(12) United States Patent
Beck

(10) Patent No.: US 7,975,600 B2
(45) Date of Patent: Jul. 12, 2011

(54) AXIAL PISTON MACHINE, RECOIL PLATE AND METHOD OF MANUFACTURING A RECOIL PLATE

(75) Inventor: Josef Beck, Villingen-Schwenningen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 1531 days.

(21) Appl. No.: 10/535,072

(22) PCT Filed: Nov. 10, 2003

(86) PCT No.: PCT/EP03/12526

§ 371 (c)(1),
(2), (4) Date: Mar. 3, 2006

(87) PCT Pub. No.: WO2004/046548

PCT Pub. Date: Jun. 3, 2004

(65) Prior Publication Data

US 2011/0094375 A1 Apr. 28, 2011

(30) Foreign Application Priority Data

Nov. 15, 2002 (DE) ..... 102 53 379
Jan. 3, 2003 (DE) ..... 103 00 070

(51) Int. Cl.
*F01B 3/00* (2006.01)
*F01B 13/04* (2006.01)

(52) U.S. Cl. ..... 92/71; 92/57

(58) Field of Classification Search ..... 92/57, 71; 91/499

See application file for complete search history.

(56) References Cited

U.S. PATENT DOCUMENTS

| | | | | |
|---|---|---|---|---|
| 4,111,103 | A | 9/1978 | Mauch | |
| 5,862,704 | A * | 1/1999 | Seljestad | 92/71 |
| 5,868,061 | A | 2/1999 | Hansen et al. | |
| 6,662,707 | B1 * | 12/2003 | Stolzer | 92/71 |

FOREIGN PATENT DOCUMENTS

| | | |
|---|---|---|
| DE | 1 728 310 | 9/1968 |
| DE | 2407 310 | 2/1974 |
| DE | 197 51 994 A1 | 5/1998 |
| DE | 199 09 311 A1 | 9/2000 |
| EP | 1 251 270 A2 | 10/2002 |

* cited by examiner

*Primary Examiner* — Michael Leslie
(74) *Attorney, Agent, or Firm* — Scully, Scott, Murphy & Presser P.C.

(57) ABSTRACT

The invention relates to an axial piston machine, in addition to a swash-plate for said machine and a method for producing a swash-plate. The swash-plate (24) is configured as a disc and has a central bore (32), which is encompassed by a collar (39), extending in an axial direction from a first surface (34, 34') of the swash-plate (24). In addition, the swash-plate (24) has several sliding block receiving openings (36), each of the latter (36) being encompassed by a guide collar (38), which extends in an axial direction from a second surface of the swash-plate (24), in the opposite direction to the collar (39) of the central bore (32).

28 Claims, 3 Drawing Sheets

AXIAL PISTON MACHINE, RECOIL PLATE AND METHOD OF MANUFACTURING A RECOIL PLATE

Figure 1:
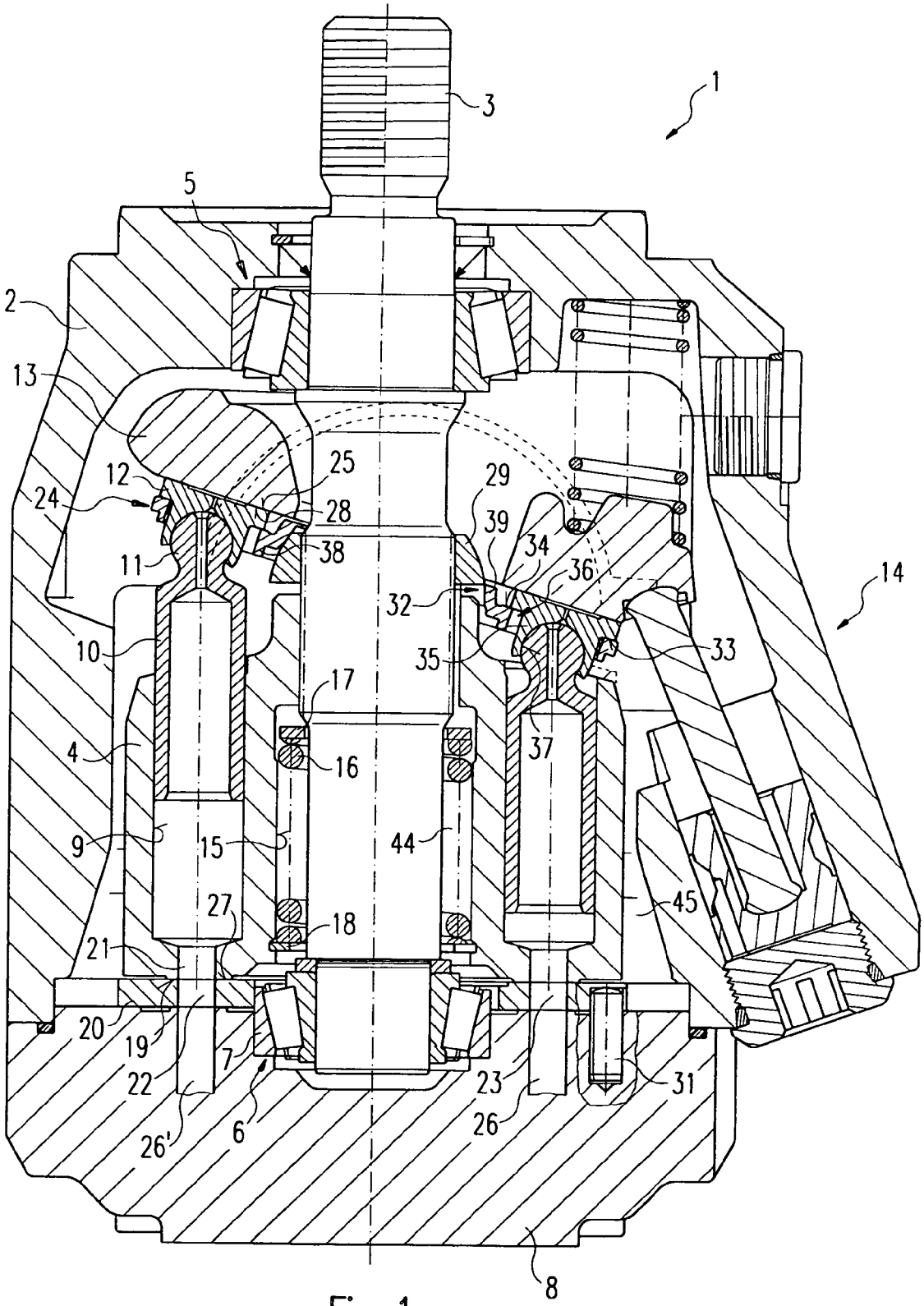

The invention relates to an axial piston machine as well as to a recoil plate provided for it and to a method of manufacturing the recoil plate.

In an axial piston machine, a cylinder drum rotates relative to an inclined plane. Introduced into the cylinder drum is a plurality of cylinder bores, in which pistons disposed in an axially displaceable manner execute a reciprocating motion. To generate the reciprocating motion, the pistons are connected in an articulated manner in each case to a sliding shoe, wherein the sliding shoes are supported on the inclined plane and therefore in the course of a relative rotational motion generate the stroke of the pistons. In order during an induction stroke to ensure that the sliding shoes abut on the inclined plane, it is known to retain the sliding shoes on the running surface by means of a recoil plate.

Such a recoil plate is known, for example, from DE 197 51 994 A1. The recoil plate proposed there has recesses, which are disposed along a peripheral circle and provided for receiving the sliding shoes. A central opening is moreover provided, with which the recoil plate is supported against a thrust bearing, wherein the thrust bearing has a spherical external geometry and is disposed on the shaft of the axial piston machine. The central opening is surrounded by a collar. The retention force is exerted by a surface of the recoil plate that is oriented in the direction of the oblique plane and abuts on the sliding shoes. The recesses, which receive the sliding shoes, are penetrated by a partially cylindrical portion of the sliding shoe.

The drawback of the known recoil plate is that radial forces, such as arise between the sliding shoe and the recoil plate during operation of the axial piston machine, may be transmitted only at the inner face of the recesses. To prevent premature wear it is therefore necessary to provide an appropriate material thickness for the recoil plate so that the length of the bores in axial direction guarantees an adequate guide height. Linked thereto is the use of cutting machining methods which, besides an unnecessarily high use of material, also increase the machining costs.

For axial piston machines of a swash-plate design, in particular, the heavy weight of the recoil plate is moreover a crucial drawback because, there, the recoil plate is a rotating components.

A further problem is that, given the use of a biased recoil plate as is likewise proposed in DE 197 51 994 A1, the deformation of the recoil plate during installation into the axial piston machine has to be taken into account in order to achieve a parallel alignment of the bores with the cylindrical portion of the sliding shoe.

The underlying object of the invention is to provide a recoil plate and an axial piston machine, which are easy to manufacture and which combine improved operation with a reduction in weight, and to provide a method of simplified manufacture of a recoil plate.

The object is achieved by the recoil plate according to the invention in accordance with claim 1, the axial piston machine according to the invention in accordance with claim 12 and the method according to the invention in accordance with claim 23.

The recoil plate according to the invention, in addition to a collar that is formed at a central through-opening, has guide collars formed in the opposite direction. The guide collars encircle in each case a sliding-shoe-receiving opening and hence increase the guide height of the sliding-shoe-receiving openings relative to the thickness of the disk-shaped recoil plate. As a result of increasing the guide height, during operation of the axial piston machine a larger supporting surface is achieved for transmitting the force in radial direction between the sliding shoe and the recoil plate. The larger supporting surface leads finally to an improvement of the wear properties.

At the same time, compared to the known recoil plate the material thickness of the disk may be decreased, thereby resulting in a reduction of the rotating mass. In this case, a considerable reduction of material is achieved in particular by the method according to the invention of manufacturing the recoil plate because the preferably cold forming in the region of the sliding-shoe-receiving openings gives rise to a hardening of the material.

Advantageous developments of the recoil plate according to the invention, of the axial piston machine according to the invention and of the method according to the invention of manufacturing the recoil plate are indicated in the sub-claims.

In particular, it is advantageous for the inner face of the guide collars to have the shape of a cylinder lateral surface, wherein it is particularly advantageous for the height of the cylinder lateral surface to comprise a substantial fraction of the overall height of the sliding-shoe-receiving openings and hence of the guide height. Thus, as large a portion as possible of the usable overall height of the recoil plate is used to form the guide height, thereby in turn reducing the wear that arises at the contact surface between the cylindrical portion of the sliding shoe and the recoil plate.

It is moreover particularly advantageous that starting from a basic body in a single operation by means of a combined punching/embossing method not only are the openings produced in the recoil plate but the edge surrounding the openings is also formed into the collar and/or the guide collars. Further machining steps, which increase the machining time, are therefore restricted to a minimum. In particular, the amount of cutting machining involved is reduced to flattening and producing a high surface quality of the surface that surrounds the central through-opening outwards in radial direction.

The basic body, which has the shape of a circular disk, also ensures a high loading capability because between the sliding-shoe-receiving openings the material of the basic body is retained. The stiffness resulting from this improves the continuous loading capability above all in respect of material fatigue.

It is moreover advantageous that in the region of the central through-opening only a small portion is hardened with the aid of a laser method. The otherwise customary distortion of the recoil plate that occurs during hardening and makes re-machining necessary in order to obtain a flat surface may therefore no longer apply. What is hardened, therefore, is only a small area where such a surface treatment is necessary in view of the subsequent wear resistance.

Figure 2A:
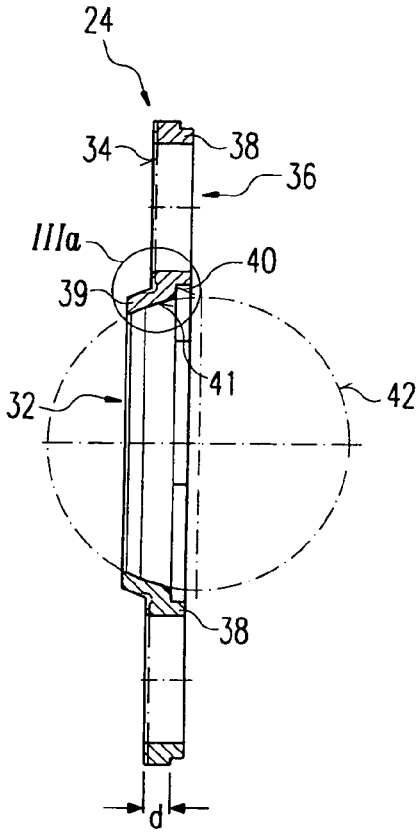
Figure 2B:
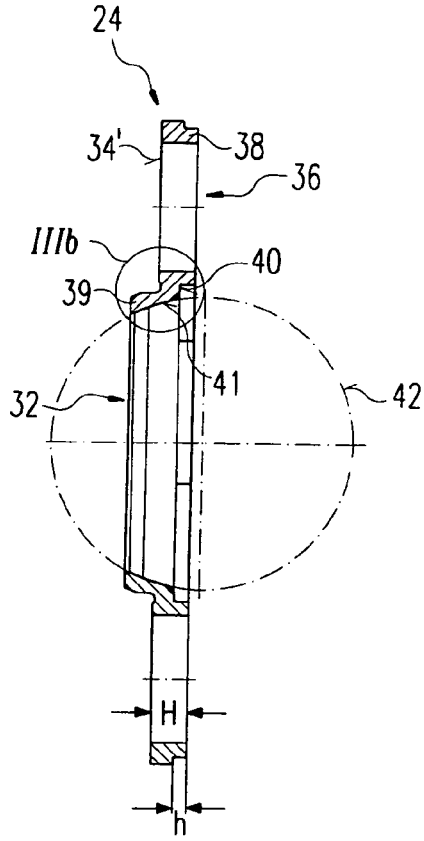
Figure 3A:
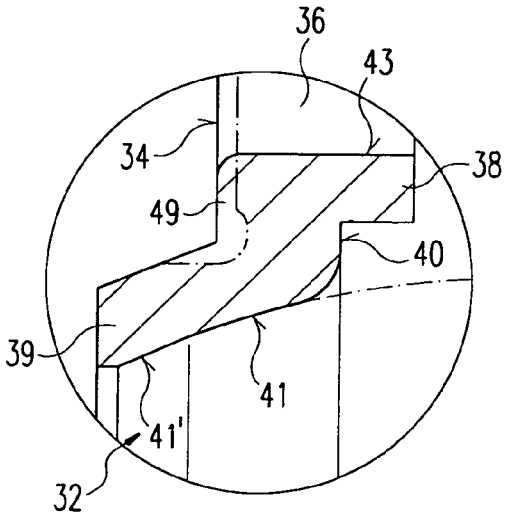
Figure 4:
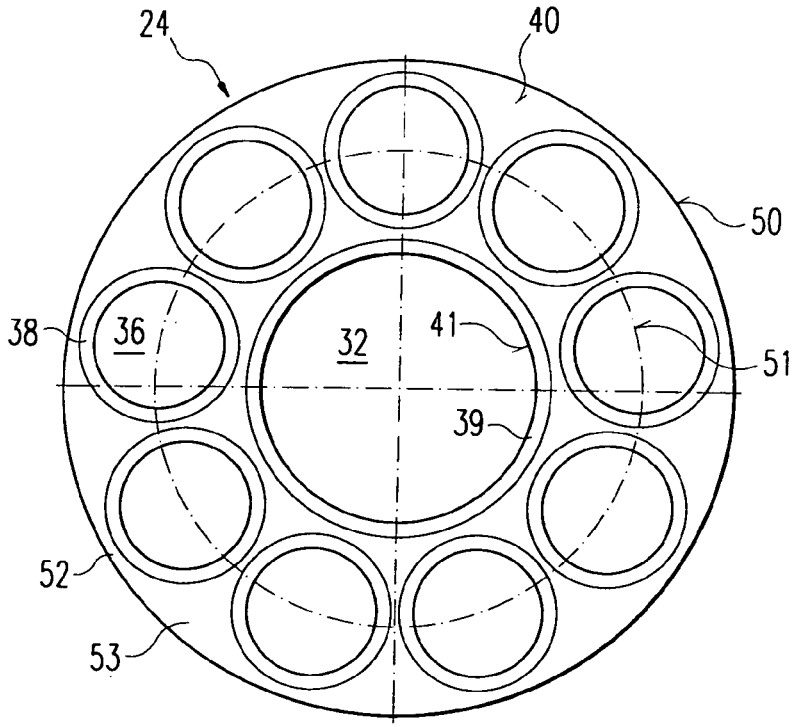

A preferred embodiment is illustrated in the drawings and described in detail below. The drawings show:

FIG. 1 a sectional view of an axial piston machine according to the invention;

FIG. 2*a, b* a recoil plate according to the invention before and after cutting machining;

FIG. 3*a, b* enlarged views of the details 111*a* and 111*b* from FIGS. 2*a* and 2*b* respectively;

FIG. 4 a plan view of a recoil plate according to the invention; and

Figure 5:
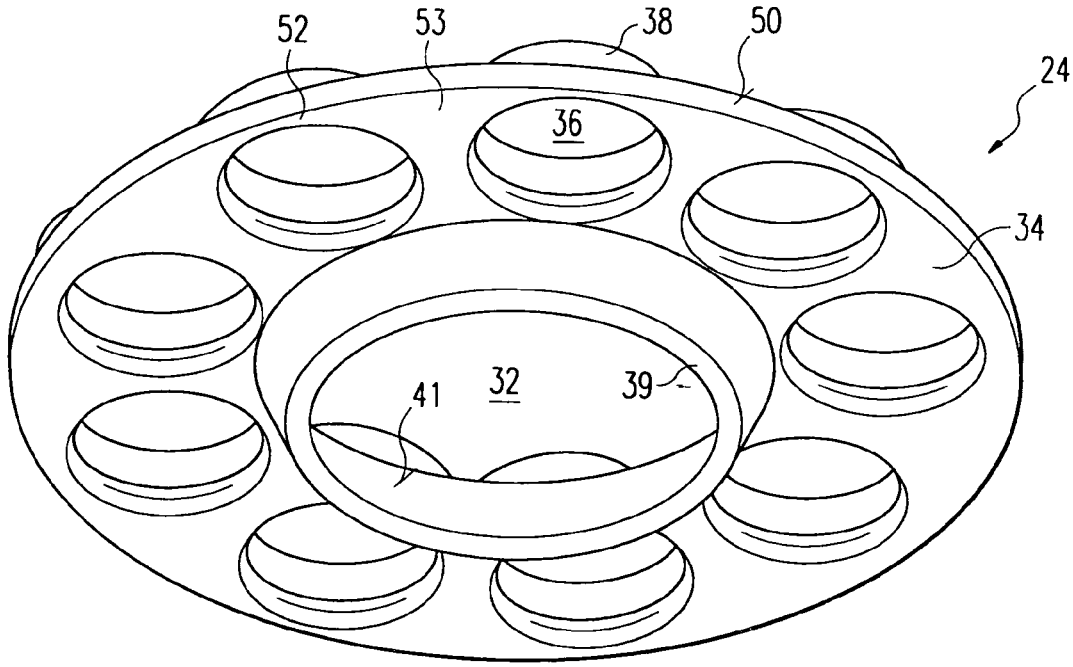

FIG. 5 a perspective view of a recoil plate according to the invention.

Before going into the details of the axial piston machine according to the invention and/or of the recoil plate according to the invention, the essential components of an axial piston machine and their function are first explained for the sake of a better understanding of the invention.

FIG. 1 shows an axial piston machine 1 comprising a shaft 3, which is supported rotatably in a housing 2 and on which a cylinder drum 4 is disposed, wherein the cylinder drum 4 and the shaft 3 are connected in a rotationally fixed manner to one another. The shaft 3 penetrates the cylinder drum 4 and is supported at both ends of the cylinder drum 4 in each case in a rolling-contact bearing 5 and 6, wherein an outer bearing ring 7 of the rolling-contact bearing 6 is inserted into a corresponding recess of a housing lid 8.

In the cylinder drum 4 a plurality of cylinder bores 9 are formed and distributed over the periphery, wherein the centre lines of the cylinder bores 9 run parallel to the centre line of the shaft 3. Inserted in the cylinder bores 9 are axially displaceable pistons 10, which at the end remote from the housing lid 8 have a spherical head 11, which interacts with a corresponding recess of a sliding shoe 12 to form an articulated joint. By means of the sliding shoes 12, the pistons 10 are supported against a swash plate 13. In the course of a rotation of the cylinder drum 4, the pistons 10 therefore execute a reciprocating motion in the cylinder bores 9. The height of the stroke is in said case defined by the position of the swash plate 13, wherein the position of the swash plate 13 in the embodiment is adjustable by means of a setting apparatus 14.

The cylinder drum 4 has a central opening 15, in which is disposed a compression spring 16, which is loaded between a first spring bearing 17 and a second spring bearing 18. The first spring bearing 17 in this case is fixed in axial direction by the shaft 3, while the second spring bearing 18 in the illustrated embodiment is formed by a Seeger circlip inserted into a groove of the cylinder drum 4. By the force of the compression spring 16 the cylinder drum 4 is therefore displaced in axial direction to such an extent that it lies with its end face 19 sealingly against a control plate 20.

The control openings 22 and/or 23 disposed in the control plate 20 are in permanent contact at their end remote from the cylinder drum 4 with at least one high-pressure and/or low-pressure connection. A high-pressure and/or low-pressure connection is illustrated by way of example and provided with the reference characters 26 and 26'. Via openings 21, the cylinder bores 9 are open in the direction of the end face 19 of the cylinder drum 4. In the course of a rotation of the cylinder drum 4 the openings 21 sweep over a sealing environment 27 of the control plate 20 and are in said case in the course of one revolution connected alternately to the control openings 22 and/or 23 of the high-pressure and/or low-pressure connection.

In axial direction the control plate 20 is supported against the housing lid 8. By means of a straight cylindrical pin 31, the control plate 20 is locked against rotation.

Despite the machining of the end face 19 of the cylinder drum 4 as well as the sealing environment 27 of the control plate 20 using methods that enable a high surface quality, a leakage occurs between the cylinder drum 4 and the control plate 20, which is also necessary for forming a hydrodynamic plain bearing. The central opening 15 of the cylinder drum 4 delimits an inner leakage volume 44, which receives some of the leakage oil. To prevent a pressure build-up in the, as such, closed-off inner leakage volume 44, a non-illustrated connection is provided between the inner leakage volume 44 and an outer leakage volume 45 of the remaining housing volume, so that a pressure equalization is possible. The leakage fluid that has collected in the outer leakage volume 45 of the housing is fed in a non-illustrated manner back to the pressure medium circuit.

In the axial piston machine 1 of a swash-plate design illustrated in FIG. 1, as has already been mentioned, the reciprocating motion of the pistons 10 is generated by means of the swash plate 13, which is arranged inclined relative to the centre line of the rotating cylinder drum 4. During operation of such an axial piston machine 1, e.g. as a pump, in said case by driving the shaft 3 the cylinder drum 4 is rotated. By means of the pressure prevailing in the cylinder bores 9, during a pressure stroke the sliding shoe 12 is held with a sliding face 25 in abutment on the swash plate 13. During the second half of a revolution of the cylinder drum 4, however, a pressure below atmospheric arises in the cylinder bores 9, with the result that the sliding shoes 12, in particular during an operation of the axial piston machine 1 in an open circuit, might lift off the swash plate 13. To prevent this, a recoil plate 24 is provided, which exerts a retention force on the sliding shoes 12 and therefore holds them on a running surface 28 of the swash plate 13.

The recoil plate 24, which is described in detail below with reference to FIGS. 2 to 5, has a central through-opening 32, with which it is supported against a thrust bearing 29. In the illustrated embodiment, the thrust bearing 29 is fixed on the shaft 3 so as to be axially non-displaceable in the direction of the housing lid 8. The thrust bearing 29 has a spherical external contour, which corresponds with a face delimiting the central through-opening 32 and enables a change of the angle of inclination of the recoil plate 24 relative to the shaft 3. In order to be able to transmit a retention force between the recoil plate 24 and the sliding shoes 12, on the sliding shoe 12 a retaining face 33 is formed, which is in contact with a flat first surface 34' of the recoil plate 24. The sliding shoes 12 further comprise a guide portion 35. The guide portion 35 of a sliding shoe 12 penetrates in each case a sliding-shoe-receiving opening 36, which is provided in the recoil plate 24. The radial extent of the sliding-shoe-receiving openings 36 is greater than the, in this region cylindrical, guide portion 35 of the sliding shoes 12.

In order in accordance with the inclination of the swash plate 13 to enable a tilting of the sliding shoes 12 relative to the pistons 10, in the region of the guide portion 35 there is provided in the sliding shoe 12 a recess 37, the geometry of which corresponds with the spherical head 11 of the piston 10. The spherical recess 37 is in said case closed to such an extent around the spherical head 11 that tensile forces are also transmissible between the sliding shoe 12 and the respective piston 10. The contact face is supplied with lubricant from the cylinder bore 9 through a lubricating oil bore in the piston 10.

FIG. 2*a* shows a recoil plate 24, in which the guide collars 38 as well as the collar 39 of the central through-opening 32 have already been formed out of a disk-shaped basic body of the thickness d. The collar 39 is in said case formed in such a way that at its inner face 41 delimiting the central through-opening 32 a spherical geometry is developed, which corresponds to the spherical geometry 42, which is illustrated diagrammatically and corresponds to the external contour of the thrust bearing 29. The collar 39 is so formed out of the basic body of the recoil plate 24 that it extends from a first surface 34 with an axial direction component out from the first surface 34.

Furthermore, the guide collars 38, which completely encircle the sliding-shoe-receiving openings 36, are already formed on the recoil plate 24 shown in FIG. 2*a*. The guide collars 38 extend in the opposite direction to the collar 39, so that the guide collars 38 extend likewise with an axial direction component out from a second surface 40 of the recoil plate 24. The forming of the basic body designed as a flat circular disk is effected preferably in a single operation simultaneously with punching of the central through-opening 32 and of the sliding-shoe-receiving openings 36. By virtue of the operation of embossing the edges of the basic body, which delimit the central through-opening 32 and the sliding-shoe-receiving openings 36, to form the collar 39 and the guide collars 38, a hardening of the material of the recoil plate 24 is additionally achieved. Thus, the thickness d of the material of the recoil plate 24 may be reduced once more without incurring problems with a continuous loading capability during operation of the axial piston machine 1.

FIG. 2*b* shows a fully machined recoil plate 24. In contrast to the recoil plate 24 illustrated in FIG. 2*a*, in the recoil plate 24 illustrated in FIG. 2*b* the first surface 34 has been machined so as to produce a flat first surface 34' that surrounds the collar 39 in radial direction at the outside. During machining of the first surface 34 to produce the flat first surface 34', exactly so much material is removed that the height of the guide collars 38 together with the material thickness d add up to an overall height H of the sliding-shoe-receiving opening 36. The formed height h of the guide collars 38 is preferably between 50% and 75% of the thickness d of the basic body. In a particularly preferred manner, the formed height h is so selected that it makes up approximately 40% of the overall height H.

FIG. 3*a* shows a detail 111*a* from FIG. 2*a* in an enlarged view. This shows both the first surface 34 and a machining allowance 49, which is indicated by the dashed line. The sliding-shoe-receiving opening 36 has an inner face 43, which has the shape of a cylinder lateral surface. During forming of the guide collars 38, the basic body is shaped in such a way that the inner face 43 in axial direction has the shape of a cylinder lateral surface, wherein the height of the cylinder lateral surface extends over a substantial fraction of the functional height. The cylinder lateral surface is produced directly by the embossing operation without any need for a cutting re-machining operation.

In the case of the inner face 41 of the central through-opening 32, in addition to the spherical portion a region 41' that has the shape of the lateral surface of a truncated cone is also provided. The region 41' is in said case the portion of the inner face 41 of the collar 39 that is furthest remote from the first surface 34.

Figure 3B:
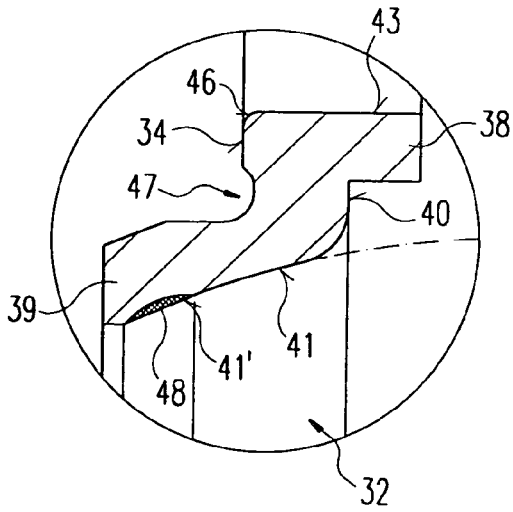

In FIG. 3*b* the detail 111*b* from FIG. 2*b* is illustrated to an enlarged scale. In the manner already explained with reference to FIG. 2*b*, the flat first surface 34' is produced on the recoil plate 24 by means of cutting machining. To enable a greater freedom of movement of the sliding shoes 12 in radial direction, an undercut 47 is provided at a transition between the collar 39 and the flat first surface 34'. During cutting machining of the flat first surface 34', a radius 46 is elaborated at the transition between the flat first surface 34' and the inner face 43. In said case, the portion of the inner face 43 that differs from the shape of a cylinder lateral surface owing to the radius 46 is kept small compared to the overall height H. Given an overall height H of e.g. approximately 5.5 mm, the radius 46 is preferably only approximately 0.6 mm. Expressed in more general terms, the radius 46 preferably makes up less than 15% of the guide height H.

As has already been explained above, the inner face 41 of the central through-opening 32 has a region 41' in the shape of the envelope of a cone. A portion of this region 41' is hardened, wherein preferably a laser method is used to harden a narrow portion 48. The heat input during laser beam hardening is locally limited and the material distortion that occurs is negligible. Cutting re-machining is therefore not necessary FIG. 4 shows a plan view of the recoil plate 24 according to the invention from the side having the guide collars 38. In the illustrated embodiment, the recoil plate 24 is manufactured from a circular disk as a basic body, so that the recoil plate 24 has a circular external contour 50.

The central through-opening 32 is introduced into the recoil plate 24 concentrically with the circular external contour 50. The sliding-shoe-receiving openings 36 are disposed on a peripheral circle 51, which is disposed likewise concentrically with the external contour 50 of the recoil plate 24. In the illustrated embodiment, nine sliding-shoe-receiving openings 36 are arranged so as to be distributed uniformly along the peripheral circle 51.

The diameter of the circular external contour 50 is so selected that the guide collars 38 completely encircle the sliding-shoe-receiving openings 36. The guide collars 38 are moreover surrounded by an outer region 52, which encircles all of the guide collars 38 as a closed circular disk. Between the guide collars 38 of adjacent sliding-shoe-receiving openings 36 disk elements 53 of the thickness d of the basic body are formed, which lend the recoil plate 24 a high degree of stiffness.

FIG. 5 shows once more an example of a recoil plate 24 in a perspective view.

In the most advantageous case, the recoil plate may be used also without post-treatment of the face in contact with the sliding shoes.

Instead of use of the recoil plate 24 according to the invention in the axial piston machine 1 of a swash-plate design, use is possible also in axial piston machines of a wobble-plate design or inclined-axis design.

The invention claimed is:

1. A recoil plate for an axial piston machine, wherein the recoil plate is disk-shaped and has a central through-opening, which is encircled by a collar, which extends with an axial direction component from a first surface of the recoil plate, and wherein the recoil plate has a plurality of sliding-shoe-receiving openings, wherein the sliding-shoe-receiving openings are encircled in each case by a guide collar, which extends with an axial direction component from a second surface of the recoil plate in the opposite direction to the collar of the central through-opening.

2. The recoil plate according to claim 1, wherein at least a portion of an inner face of the guide collar that in each case delimits the sliding-shoe-receiving opening has the shape of a cylinder lateral surface.

3. The recoil plate according to claim 2, wherein the height of the cylinder lateral surface is a substantial fraction of an overall height (H) of the sliding-shoe-receiving opening.

4. The recoil plate according to, claim 1 wherein the first surface of the recoil plate in a region, which surrounds the collar in radial direction at the outside, is a flat surface.

5. The recoil plate according to claim 1 wherein the sliding-shoe-receiving openings are completely encircled by a radially outer region of the recoil plate.

6. The recoil plate according to claim 5, wherein the radially outer region of the recoil plate has a circular external contour.

7. The recoil plate according to claim 1
wherein a portion of an inner face of the collar that delimits the central through-opening in radial direction has a spherical shape.

8. The recoil plate according to claim 1
wherein at least one portion of the inner face of the collar that delimits the central through-opening is hardened.

9. The recoil plate according to claim 1
wherein the collar and the guide collars are formed by shaping a flat basic body.

10. The recoil plate according to claim 9,
wherein the basic body is a circular disk.

11. The recoil plate according to claim 1
wherein the collar and the oppositely directed guide collars are formed in a punching/embossing process.

12. An axial piston machine comprising a cylinder drum (4), which rotates relative to a running surface, which is arranged inclined relative thereto and on which sliding shoes are supported by a sliding face in order to generate a reciprocating motion of pistons, which are axially displaceable in cylinder bores of the cylinder drum, wherein the sliding shoes during an induction stroke are held by means of a recoil plate in abutment on the running face and the recoil plate for receiving the sliding shoes has sliding-shoe-receiving openings, in each case a retaining face of the sliding shoe that is oriented in the opposite direction to the sliding face of the sliding shoes abuts on a first surface of the recoil plate and the recoil plate is supported by an inner face of a collar that encircles a central through-opening against a thrust bearing and the collar extends with an axial direction component from the first surface,
wherein the sliding-shoe-receiving openings are encircled in each case by a guide collar, which extends with an axial direction component from a second surface of the recoil plate in the opposite direction to the collar of the central through-opening.

13. The axial piston machine according to claim 12,
wherein at least a portion of an inner face of the guide collar that in each case delimits the sliding-shoe-receiving opening has the shape of a cylinder lateral surface.

14. The axial piston machine according to claim 13,
wherein the height of the cylinder lateral surface is a substantial fraction of an overall height (H) of the sliding-shoe-receiving opening.

15. The axial piston machine according to claim 12
wherein the first surface of the recoil plate in a region, which surrounds the collar in radial direction at the outside, is a flat surface.

16. The axial piston machine according to claim 12
wherein the sliding-shoe-receiving openings are completely encircled by a radially outer region of the recoil plate.

17. The axial piston machine according to claim 16,
wherein the radially outer region of the recoil plate has a circular external contour.

18. The axial piston machine according to claim 12
wherein a portion of an inner face of the collar that delimits the central through-opening in radial direction has a spherical shape.

19. The axial piston machine according to claim 12
wherein at least a portion of the inner face of the collar that delimits the central through-opening is hardened.

20. The axial piston machine according to claim 12
wherein the collar and the guide collars are formed by shaping a flat basic body.

21. The axial piston machine according to claim 20,
wherein the basic body is a circular disk.

22. The axial piston machine according to claim 12
wherein the collar and the oppositely directed guide collars are formed in a punching/embossing process.

23. A method of manufacturing a recoil plate for an axial piston machine comprising the following method steps:
manufacture a disk-shaped basic body;
punch sliding-shoe-receiving openings;
punch a central through-opening;
shape an inner edge of the disk-shaped basic body that delimits the central through-opening into a collar such that the collar extends with an axial direction component from a first surface of the recoil plate; and
shape an edge of the disk-shaped basic body that in each case delimits the sliding-shoe-receiving openings into in each case a guide collar such that the guide collars extend with an axial direction component from a second surface of the recoil plate.

24. The method according to claim 23,
wherein at least one portion of an inner face of the collar is hardened.

25. The method according to claim 24,
wherein the portion of the inner face is hardened with the aid of a laser.

26. The method according to claim 23
wherein the edges of the sliding-shoe-receiving openings and the inner edge of the central through-opening are formed into the guide collars and the collar in a common embossing process.

27. The method according to claim 26,
wherein punching-out of the central through-opening and of the sliding-shoe-receiving openings and forming of the edges is carried out in a single operation in a punching/embossing process.

28. The method according to claim 23
wherein the first surface of the disk-shaped basic body remote from the guide collars is, after forming, machined in respect of its flatness and surface quality.

* * * * *